US011521584B2

(12) United States Patent
Cho

(10) Patent No.: US 11,521,584 B2
(45) Date of Patent: Dec. 6, 2022

(54) DRUM PEDAL

(71) Applicant: Han Sang Cho, Seoul (KR)

(72) Inventor: Han Sang Cho, Seoul (KR)

( * ) Notice: Subject to any disclaimer, the term of this patent is extended or adjusted under 35 U.S.C. 154(b) by 0 days.

(21) Appl. No.: 17/771,018

(22) PCT Filed: Dec. 3, 2020

(86) PCT No.: PCT/KR2020/017551
§ 371 (c)(1),
(2) Date: Apr. 22, 2022

(87) PCT Pub. No.: WO2021/145559
PCT Pub. Date: Jul. 22, 2021

(65) Prior Publication Data

US 2022/0351706 A1 Nov. 3, 2022

(30) Foreign Application Priority Data

Jan. 14, 2020 (KR) ..... 10-2020-0004631

(51) Int. Cl.
*G10D 13/11* (2020.01)
*G10D 13/12* (2020.01)

(52) U.S. Cl.
CPC ..... *G10D 13/11* (2020.02); *G10D 13/12* (2020.02)

(58) Field of Classification Search
CPC ..... G10D 13/11; G10D 13/12
See application file for complete search history.

(56) References Cited

U.S. PATENT DOCUMENTS 5,574,237 A * 11/1996 Yanagisawa ..... G10D 13/11 84/422.1
9,251,770 B1 2/2016 Tsuchida
10,475,423 B1 * 11/2019 Hirasawa ..... G10D 13/11
2004/0020345 A1 2/2004 Matsuzoe et al.
2007/0113722 A1 * 5/2007 Chen ..... G10D 13/11 84/422.1
2017/0110098 A1 4/2017 Shigenaga
(Continued)

FOREIGN PATENT DOCUMENTS

JP 08-248948 A 9/1996
JP 2016-048293 A 4/2016
(Continued)

OTHER PUBLICATIONS

International Search Report for PCT/KR2020/017551 dated Mar. 5, 2021 from Korean Intellectual Property Office.

*Primary Examiner* — Jianchun Qin
(74) *Attorney, Agent, or Firm* — Revolution IP, PLLC

(57) ABSTRACT

A drum pedal is characterized by including: a base part; a pair of support parts provided at the front side of the base part; a cam part that is axially coupled to the pair of support parts via a main shaft; a hitting part that is axially coupled to the pair of support parts via the main shaft and disposed to be adjacent to the cam part; a pedal part of which one end is coupled to the rear side of the base part and which is formed to extend in the direction of the front side of the base part; and a power transmission part that connects the cam part and the pedal part and rotates the main shaft and the cam part according to a load applied to the pedal part, wherein at least two different power transmission parts can be selectively coupled to the cam part.

6 Claims, 12 Drawing Sheets

(56) References Cited

U.S. PATENT DOCUMENTS

| | | | | |
|---|---|---|---|---|
| 2017/0278491 | A1 | 9/2017 | Shigenaga | |
| 2020/0043450 | A1* | 2/2020 | Shigenaga | G10D 13/11 |

FOREIGN PATENT DOCUMENTS

| | | | |
|---|---|---|---|
| JP | 2017-078774 | A | 4/2017 |
| JP | 2017-173711 | A | 9/2017 |
| KR | 10-2004-0011386 | A | 2/2004 |

* cited by examiner

【Figure 1】
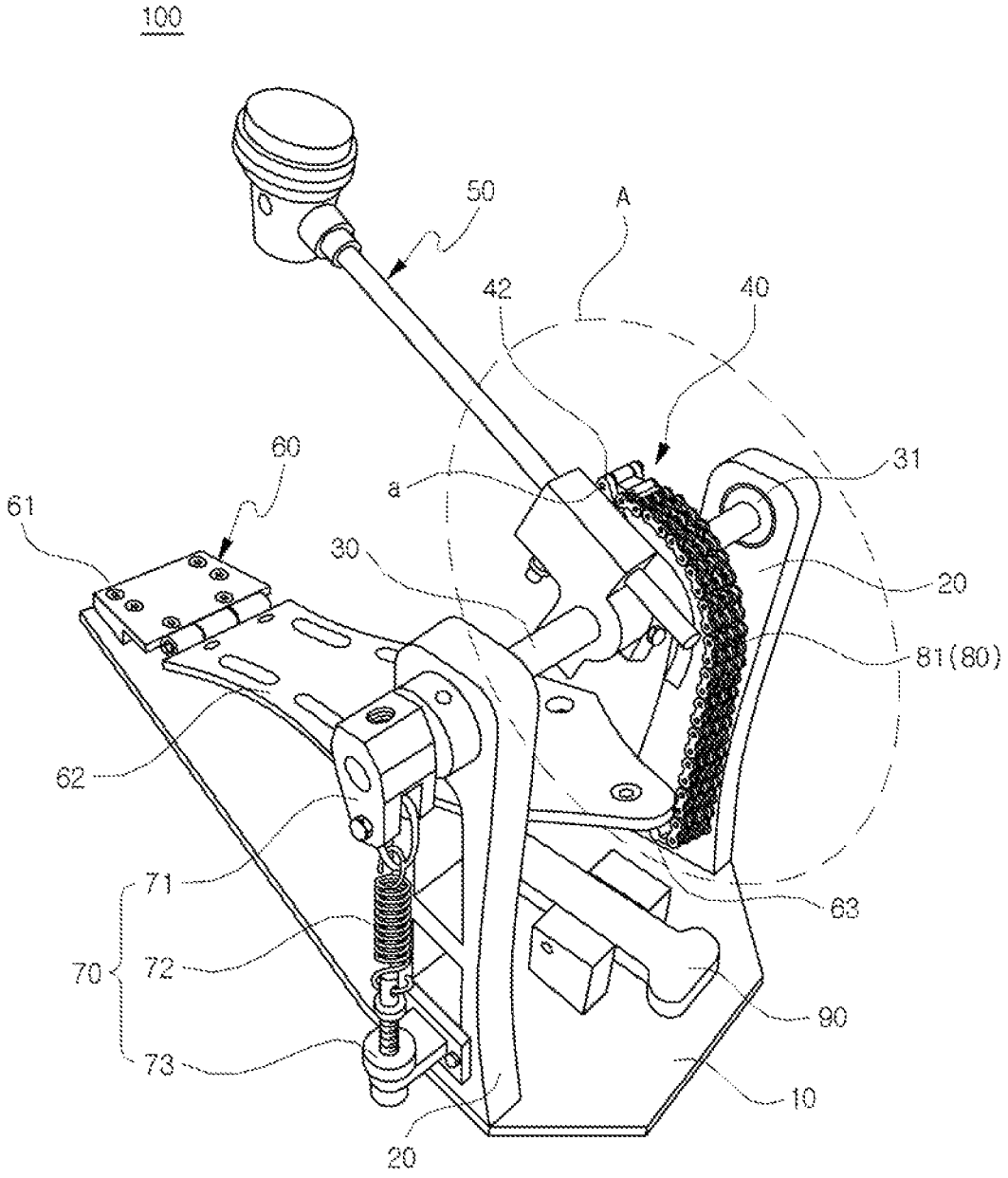

【Figure 2】
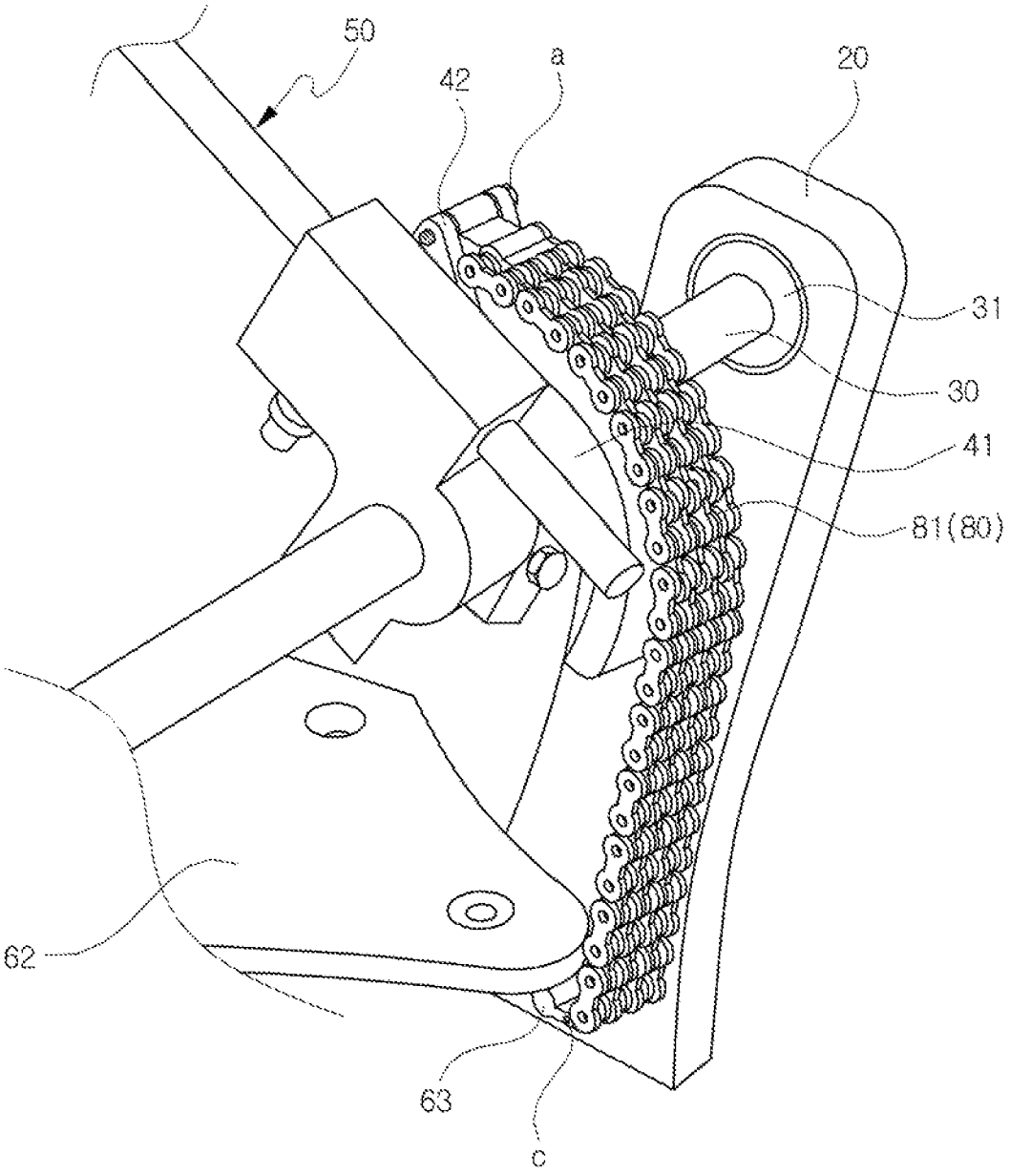

【Figure 3】
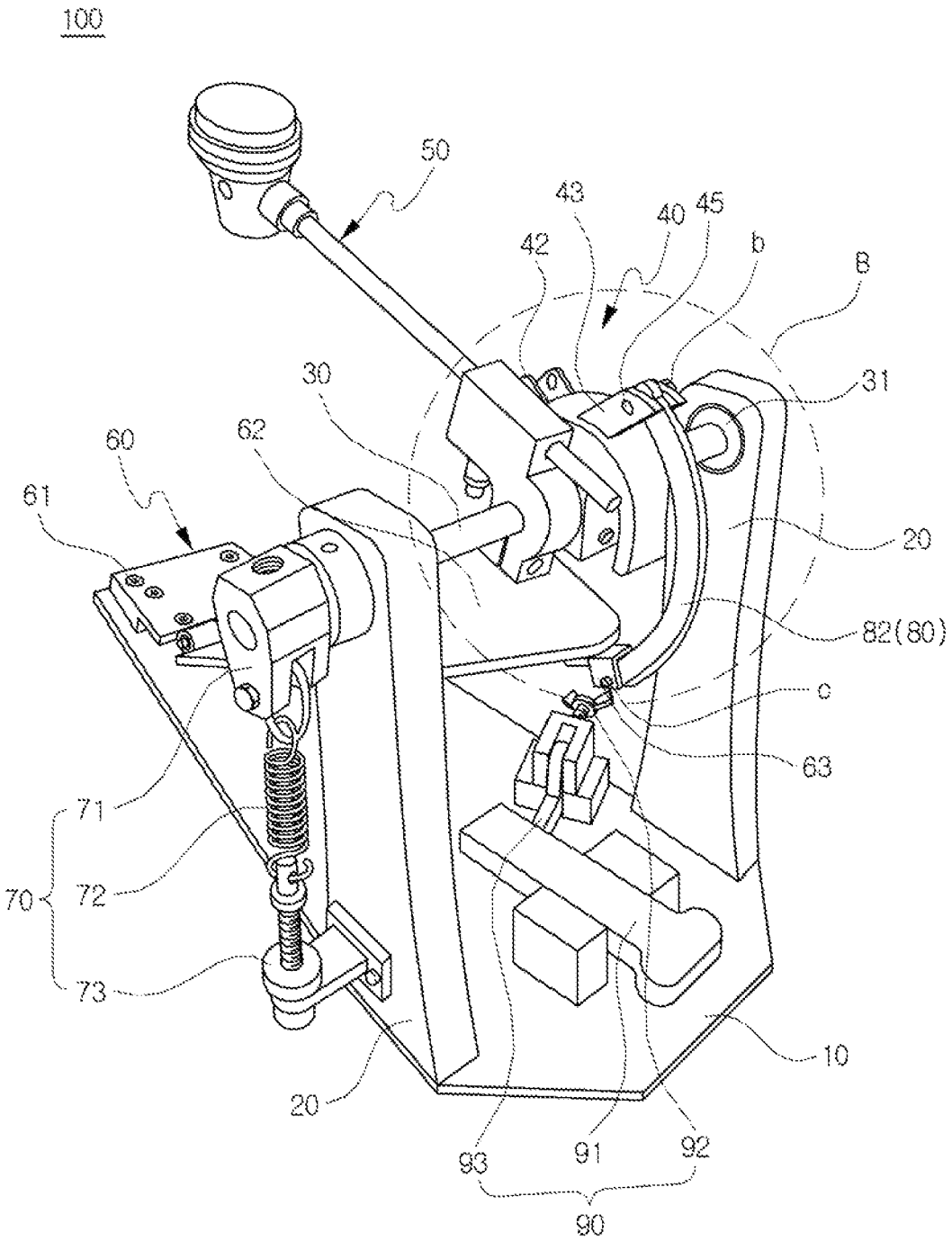

【Figure 4】
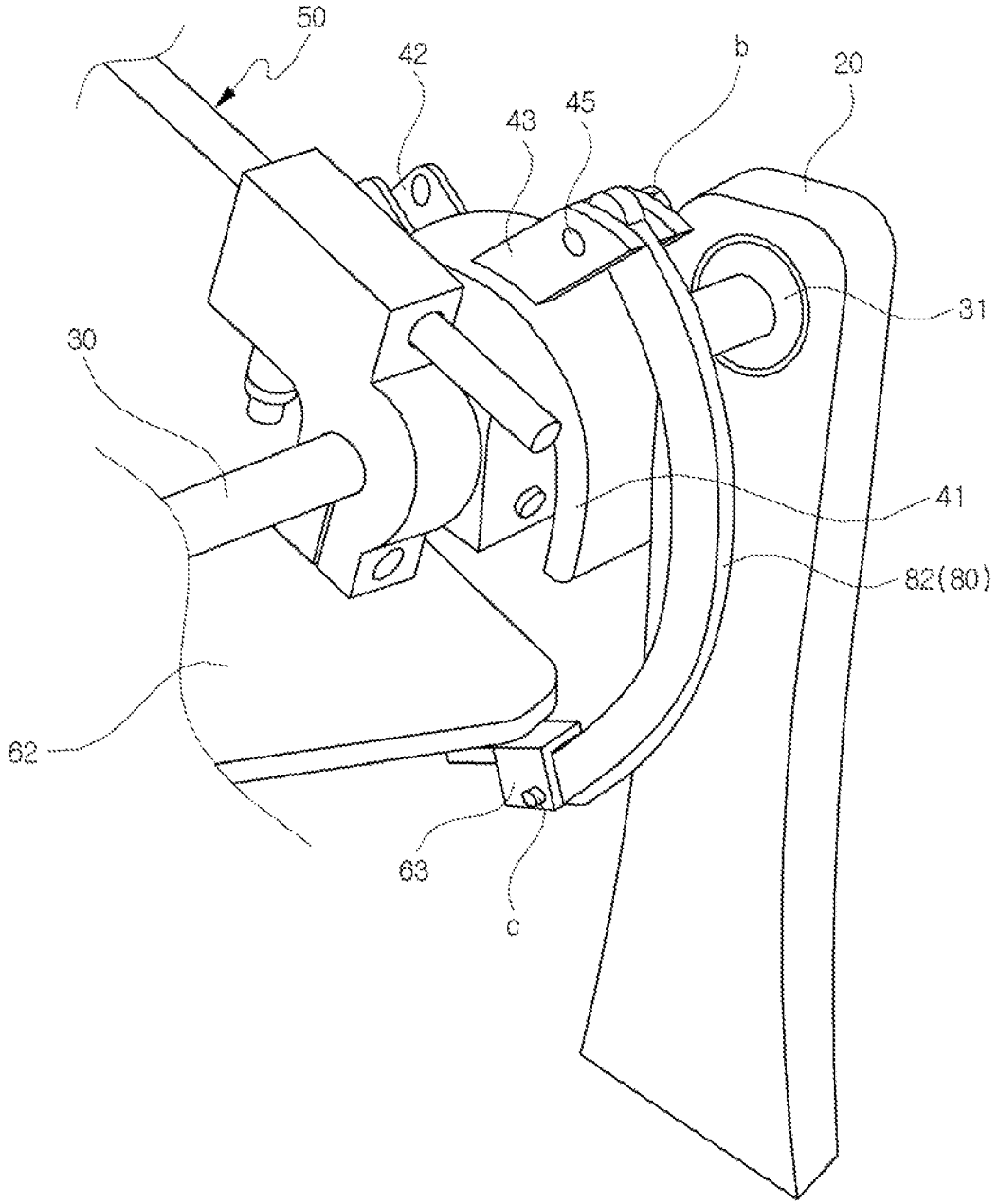

【Figure 5】
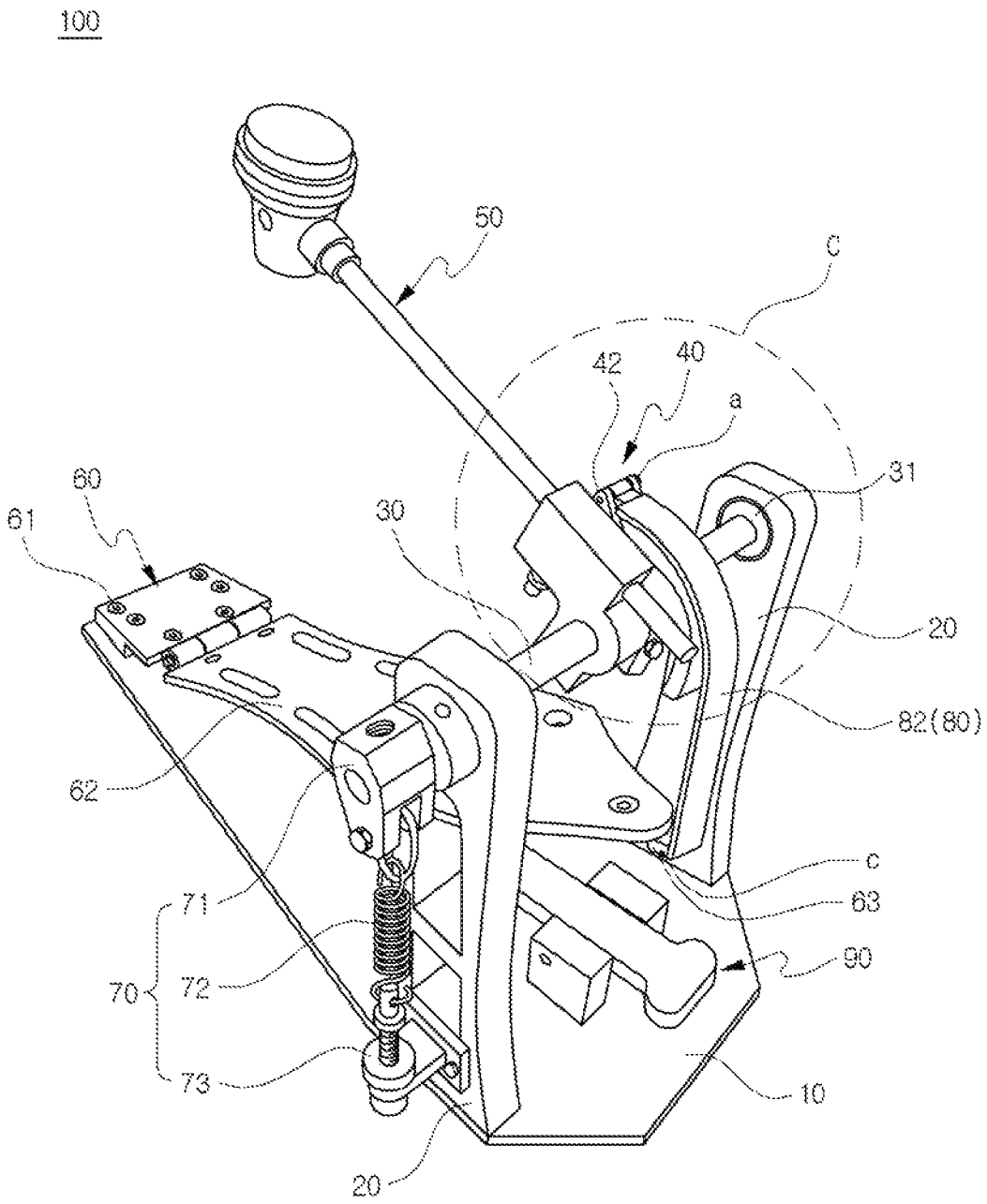

【Figure 6】
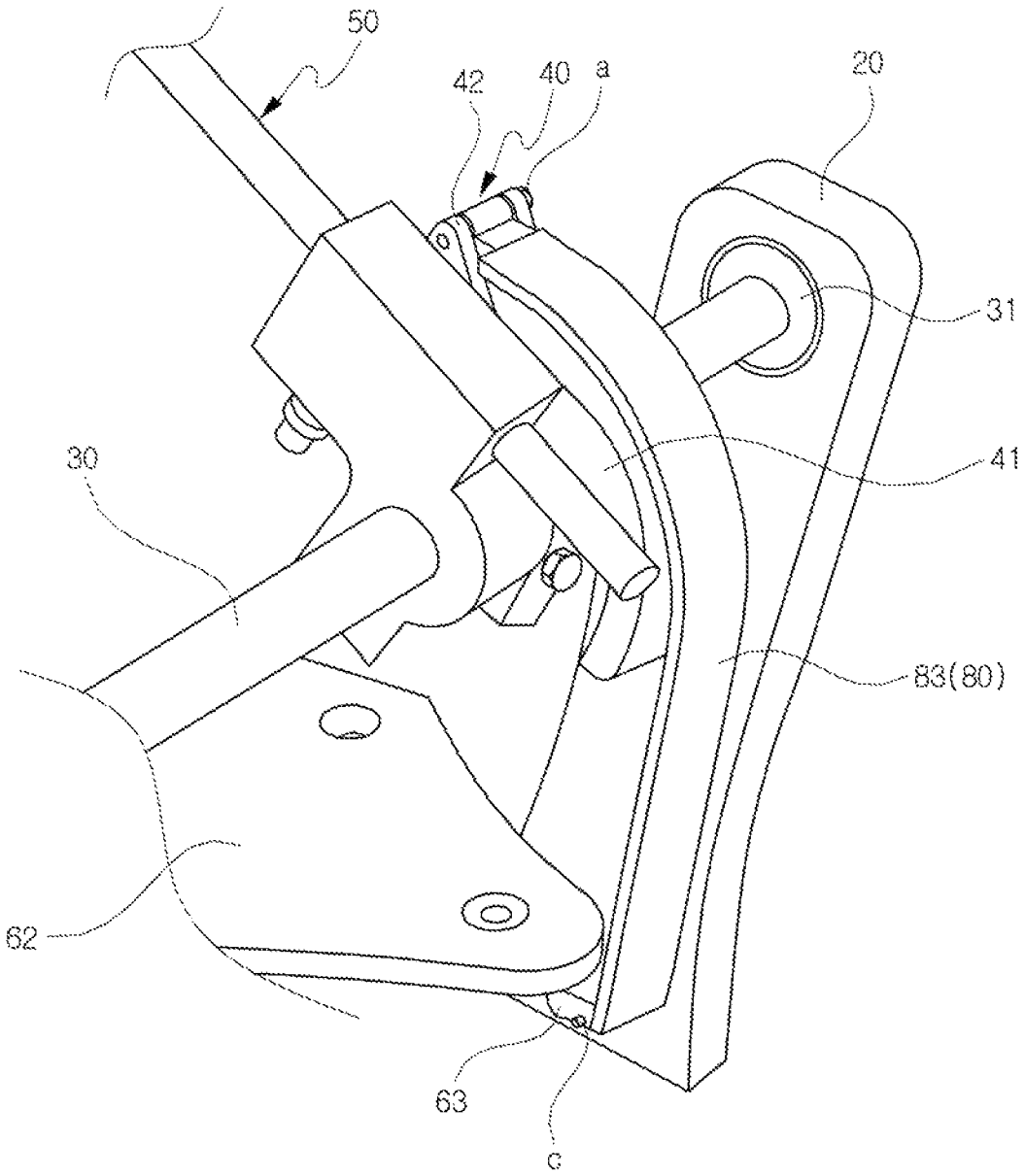

【Figure 7】
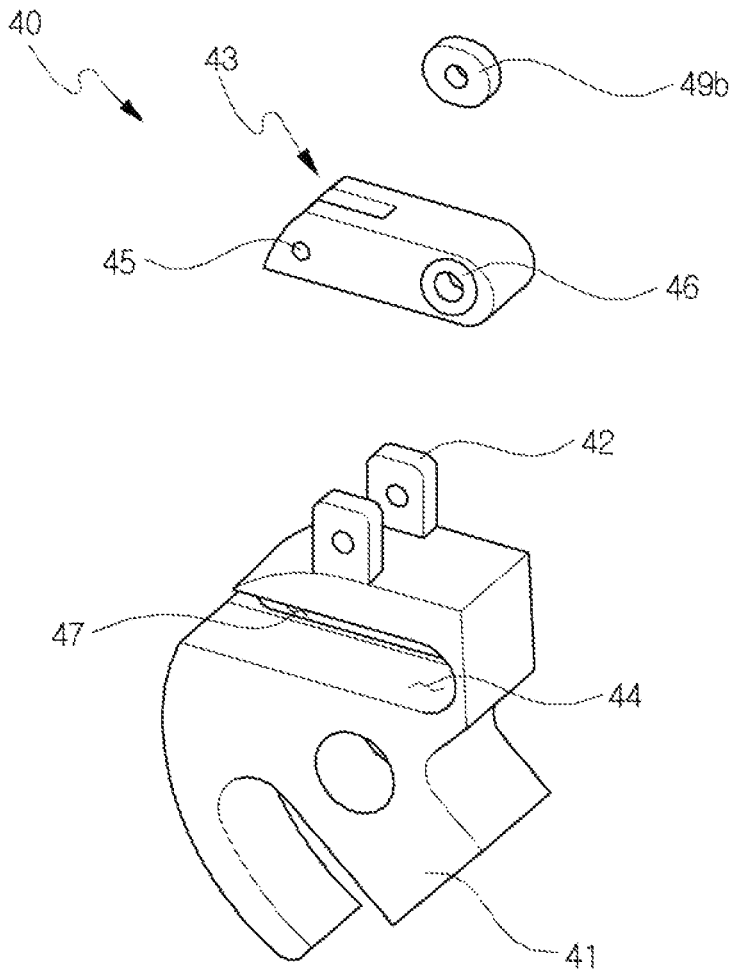

【Figure 8】
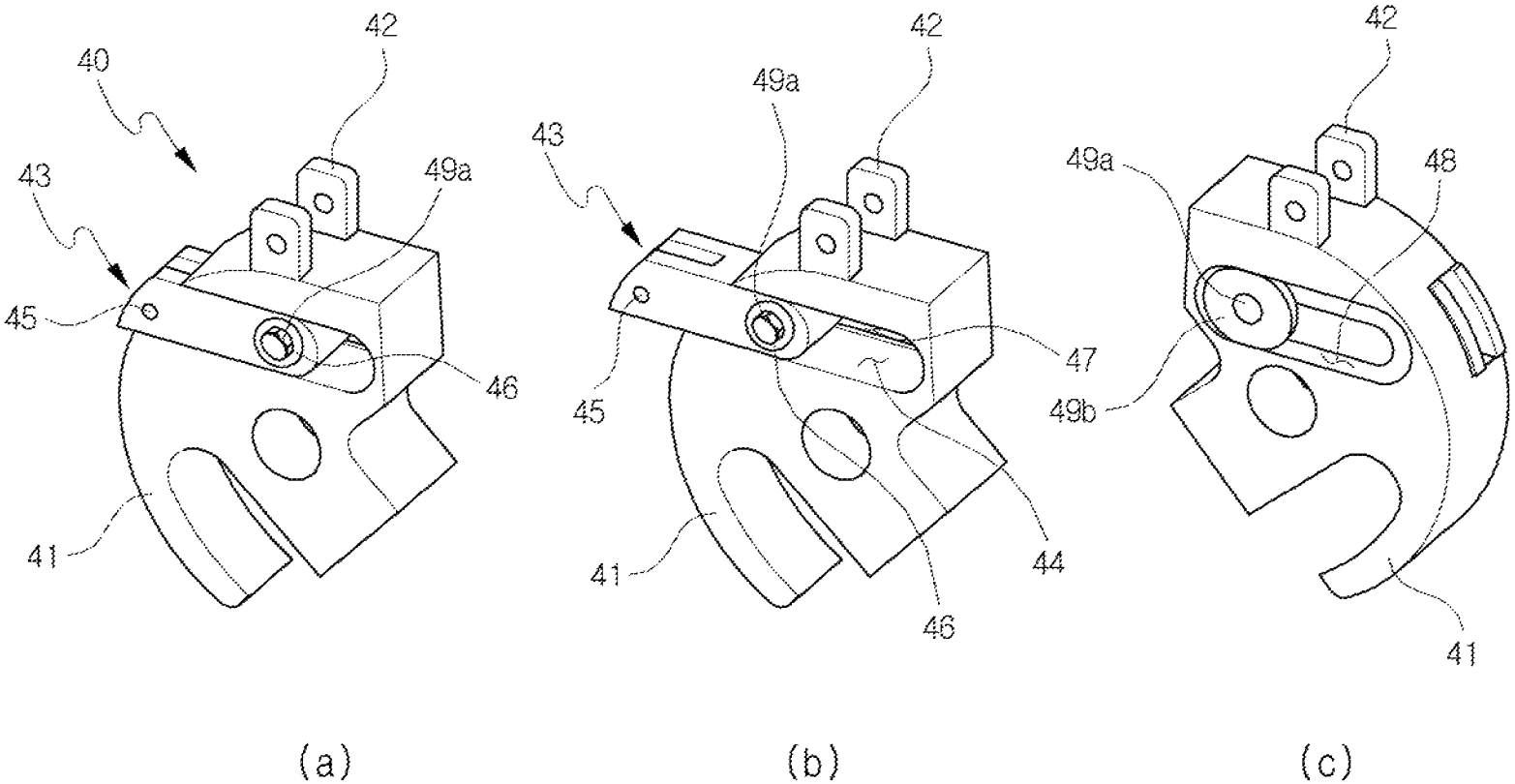

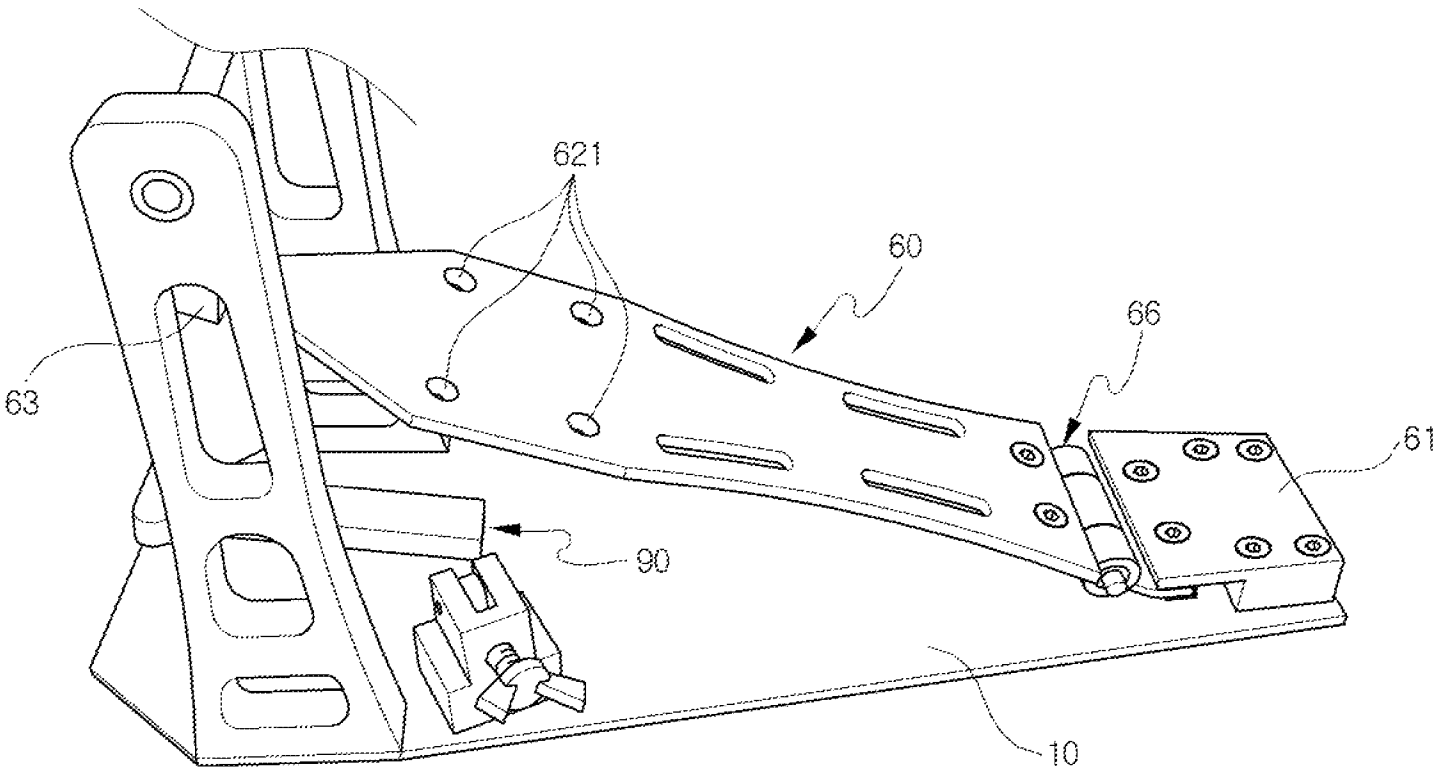
【Figure 9】

【Figure 10A】
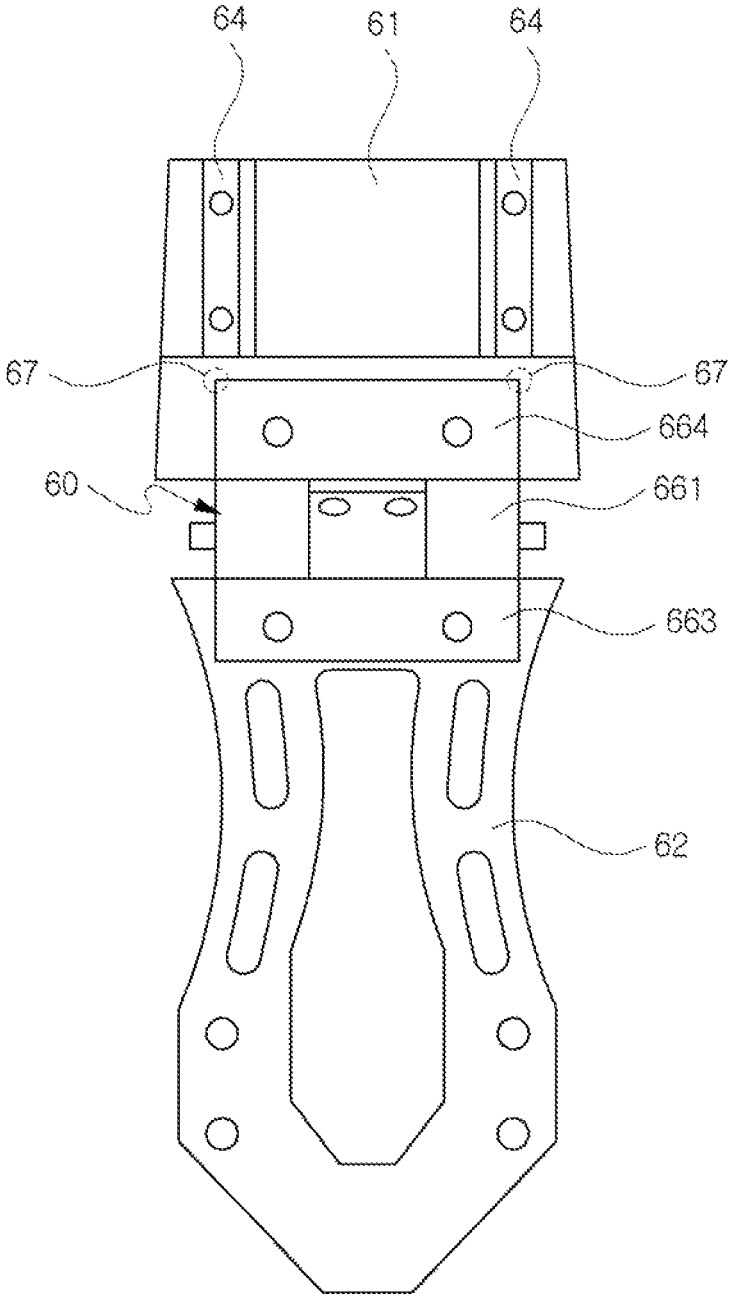

【Figure 10B】
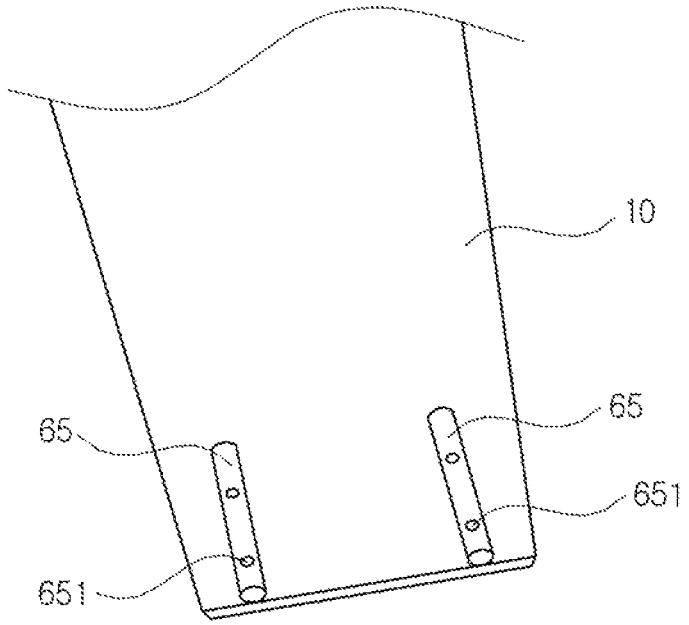
【Figure 10C】
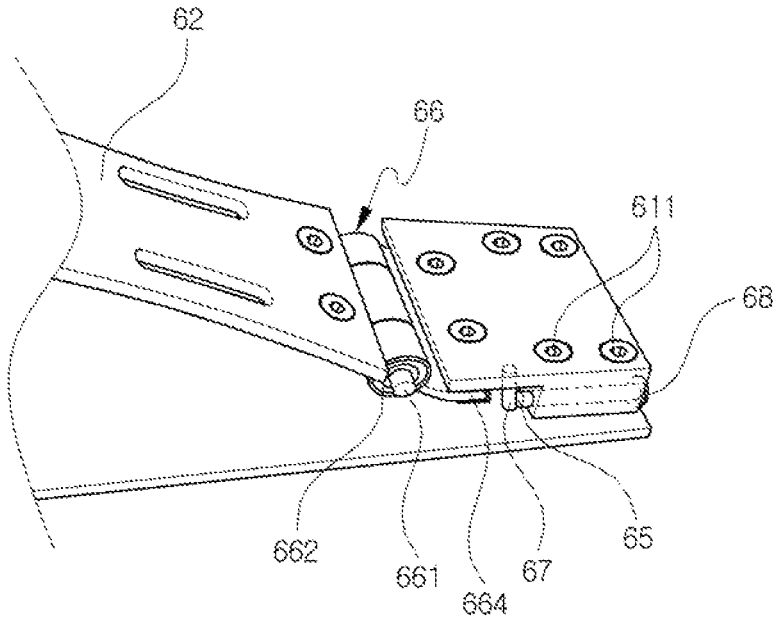

【Figure 10D】
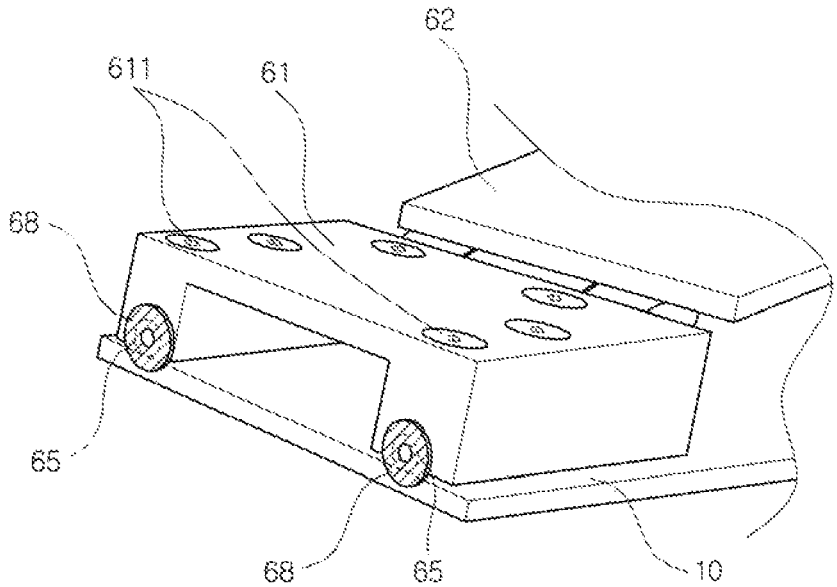
【Figure 10E】
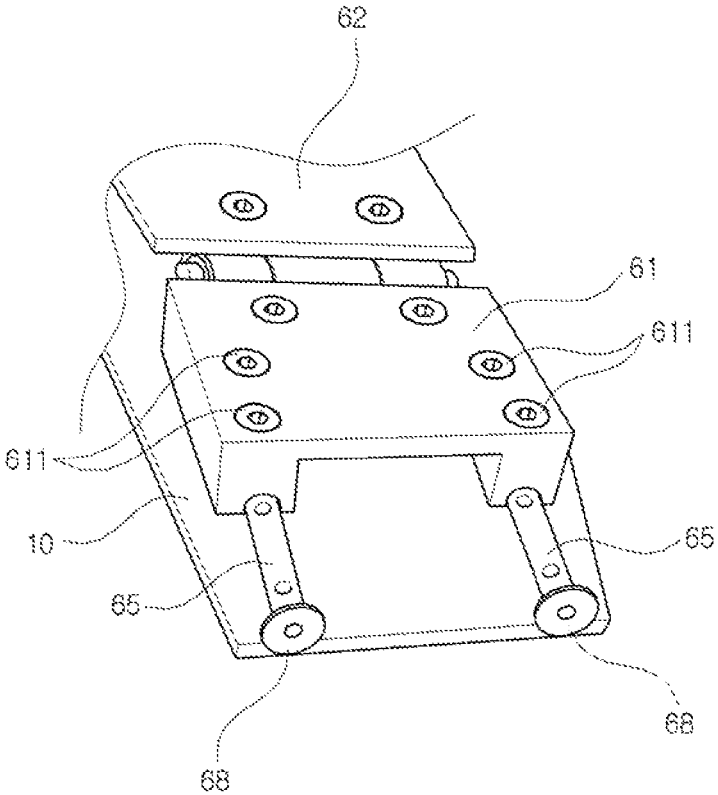

DRUM PEDAL

CROSS REFERENCE TO PRIOR APPLICATIONS

This application is a National Stage Application of PCT International Patent Application No. PCT/KR2020/017551 filed on Dec. 3, 2020, under 35 U.S.C. § 371, which claims priority to Korean Patent Application No. 10-2020-0004631 filed on Jan. 14, 2020, which are all hereby incorporated by reference in their entirety.

TECHNICAL FIELD

The present invention relates to a drum pedal, and more particularly, to a drum pedal capable of variously changing the coupling between a footrest part and a cam without replacing the drum pedal.

BACKGROUND ART

A drum pedal generally refers to a pedal used when a base drum is played. Drummers may play the base drum by stepping on the drum pedal with their feet.

Depending on a configuration of connecting the cam and the footrest among components constituting the drum pedal, the drum pedal may be divided into a chain type, a strap type, a link type, and the like.

Each type may have a difference in stiffness and tensile strength (force to resist to tension generated as the drummer steps on the footrest), and may have a difference in a rotation radius size of the cam when the drummer steps on the footrest.

On the other hand, since the musical tastes, physical conditions, and the like pursued by the drummer are different from each other, there may be a case where a drum pedal suitable for a specific drummer is not suitable for other drummers.

In the case of a conventionally proposed drum pedal, in order to change a type of drum pedal according to a drummer's preference, there are cumbersome and cost problems to replace the drum pedal itself with a different type.

DISCLOSURE

Technical Problem

The present invention has been devised to solve the above problems, and an object of the present invention is to provide a drum pedal capable of variously changing a coupling between a cam and a pedal part without replacing the drum pedal.

Technical Solution

A drum pedal according to an embodiment of the present invention is characterized by comprising: a base part; a pair of support parts provided at the front side of the base part; a cam part that is axially coupled to the pair of support parts via a main shaft; a hitting part that is axially coupled to the pair of support parts via the main shaft and disposed to be adjacent to the cam part; a pedal part of which one end is coupled to the rear side of the base part and which is formed to extend in the direction of the front side of the base part; and a power transmission part that connects the cam part and the pedal part and rotates the main shaft and the cam part according to a load applied to the pedal part, wherein at least two different power transmission parts are able to be selectively coupled to the cam part.

Preferably, a rotation radius of the cam part may vary depending on a position of an action point at which at least two different power transmission parts are coupled to the cam part, and the power transmission part may be any one of a chain, a link, and a strap.

Preferably, the cam part may include a cam body having a hole which is inserted through the main shaft, a first connection part that is formed above the cam body and to which one end of the chain or the strap is coupled by a first fixing member, a link connection guide part that is insertable into the cam part and movable in a front-rear direction, and a guide insertion part which is formed in a longitudinal direction on a first surface of the cam body so that the link connection guide part is inserted, wherein a second connection part to which one end of the link is coupled by a second fixing member may be formed on the front side of the link connection guide part, and a link connection guide fixing part may be formed on the rear side of the link connection guide part so that the rear side of the link connection guide part is fixed to the cam body when the link connection guide part protrudes forward.

Preferably, the link connection guide part may be inserted into the guide insertion part, a long hole through which a link connection guide fixing bolt penetrates may be formed in one side of the guide insertion part, and a longitudinal groove into which a link connection guide fixing nut is insertable may be formed in a second surface opposite to the first surface of the cam body.

Preferably, the link connection guide fixing bolt may be inserted into the link connection guide fixing part, and the link connection guide fixing nut may fasten the link connection guide fixing bolt passing through the long hole in the direction of the second surface with the cam body.

Preferably, the pedal part may include a heel part coupled to the rear side of the base part and movable in a front-rear direction, a pedal board rotatably provided with respect to the heel part, and a third connection part formed on the front side of the pedal board and coupled with the other end of the power transmission part by a third fixing member.

Preferably, the drum pedal may further include a restoration part which include a crank which is fixed to the main shaft, and an elastic part of which one end is connected to the crank and the other end is connected to a tension adjustment member coupled to any one of the pair of support parts, wherein when a load applied to the pedal part is released, the restoration part may apply an elastic force to the main shaft so that the pedal part and the hitting part are restored to original positions.

Preferably, the drum pedal may further include a clamping part which is formed at the front side of the base part to support the base drum.

Advantageous Effects

According to an embodiment of the present invention, it is possible to variously adjust an operation method or operation range of the drum pedal according to a user's request simply without replacing the drum pedal by variously changing a coupling method between the cam part and the pedal part.

In addition, since it is possible to provide a feeling of stepping on various types of drum pedals to a user even without replacement of the drum pedal, there is an effect of reducing costs.

DESCRIPTION OF DRAWINGS

FIG. 1 is a diagram illustrating a chain type of drum pedal according to an embodiment of the present invention.

FIG. 2 is an enlarged diagram of part A of FIG. 1.

FIG. 3 is a diagram illustrating a link type of drum pedal according to an embodiment of the present invention.

FIG. 4 is an enlarged diagram of part B of FIG. 3.

FIG. 5 is a diagram illustrating a strap type of drum pedal according to an embodiment of the present invention.

FIG. 6 is an enlarged diagram of part C of FIG. 5.

FIGS. 7 and 8 are diagrams illustrating a cam part in detail according to an embodiment of the present invention.

FIGS. 9 and 10A-10E are diagrams illustrating a pedal part in detail according to an embodiment of the present invention.

BEST MODE

Hereinafter, a preferred embodiment of the present invention will be described in detail with reference to the accompanying drawings. First, when reference numerals refer to components of each drawing, it is to be noted that although the same components are illustrated in different drawings, the same components are denoted by the same reference numerals as possible. In the following description, a detailed explanation of related known configurations or functions may be omitted to avoid obscuring the subject matter of the present invention. Further, hereinafter, the preferred embodiment of the present invention will be described, but the technical spirit of the present invention is not limited thereto or restricted thereby and the embodiments can be modified and variously executed by those skilled in the art.

FIG. 1 is a diagram illustrating a chain type of drum pedal according to an embodiment of the present invention, FIG. 2 is an enlarged diagram of part A of FIG. 1, FIG. 3 is a diagram illustrating a link type of drum pedal according to an embodiment of the present invention, FIG. 4 is an enlarged diagram of part B of FIG. 3, FIG. 5 is a diagram illustrating a strap type of drum pedal according to an embodiment of the present invention, FIG. 6 is an enlarged diagram of part C of FIG. 5, and FIGS. 7 and 8 are diagrams illustrating a cam part in detail according to an embodiment of the present invention.

Referring to FIG. 1, the drum pedal 100 according to an embodiment of the present invention may include a base part 10, a pair of support part 20 formed at the front side of the base part and coupled to the base part 10 in an approximately vertical direction, a cam part 40 that axially coupled to the pair of support parts 20 via a main shaft 30, a hitting part 50 that is axially coupled to the pair of support parts via the main shaft 30 and disposed to be adjacent to the cam part 40, a pedal part 60 of which one end is coupled to the rear side of the base part 10 and which is formed to extend in the direction of the front side of the base part 10, and a power transmission part 80 that connects the cam part 40 and the pedal part 60 and rotates the main shaft 30 and the cam part 40 according to a load applied to the pedal part 60.

The base part 10 may be formed of a metal material or other synthetic plastic materials, and preferably, may be formed of an aluminum or iron material having a thickness of 2 mm to 4 mm. In addition, the base part 10 supports the pair of support parts 20, the pedal part 60, and the like described above, thereby providing the stability when the user operates the drum pedal 100.

In addition, both ends of the main shaft 30 are supported by a main shaft bearing 31 in each hole of the pair of support parts 20 to be rotatably coupled thereto.

The hitting part 50 is configured to hit the head of a base drum (not illustrated) to generate a sound from the base drum, and as illustrated in FIG. 1, may include a rod part of which one end is axially coupled to the main shaft 30 and a hammer part which is coupled to the other end of the rod part to hit the base drum.

The above-described hitting part 50 may hit the base drum according to the rotation of the main shaft 30 generated while the power transmission part 80 connected to the pedal part 60 rotates the cam part 40 when the user steps on the pedal part 60 to apply a load to the pedal part 60.

As illustrated in FIG. 1, the pedal part 60 includes a heel part 61 that is coupled to the rear side of the base part 20 and movable in a front-rear direction, and a pedal board 62 that is hinge-coupled to the heel part 61 and vertically rotatable based on an axis coupled to the heel part 61, and the other end of the power transmission part 80 may be coupled to the front side of the pedal board 62.

A user's heel may be positioned on the heel part 61, and a user's foot except for the heel may be positioned on the pedal board 62. The detailed configuration of the above-described pedal part 60 will be described in detail below with reference to FIGS. 9 and 10.

As illustrated in FIGS. 1 to 8, one end of the power transmitting part 80 is coupled to the cam part 40, and the cam part 40 may be rotated by the power transmitted from the power transmission part 80 of which the other end is coupled to the pedal board 62.

The cam part 40 includes a plurality of coupling positions formed with different distances from the rotation center, and a rotation radius may vary depending on a position of an action point at which the power transmission part 80 is coupled to the cam part 40.

At this time, the power transmission part 80 may be a chain 81 as illustrated in FIGS. 1 and 2, a link 82 as illustrated in FIGS. 3 and 4, or a strap 83 as illustrated in FIGS. 5 and 6.

As illustrated in FIGS. 1 to 6, in a state in which the power transmission part 80 is coupled to a cam body 41 and the pedal board 62, the power transmission part 80 may be positioned to surround a portion (a curved portion of the cam body 41) of the outer peripheral surface of the cam body 41.

In addition, when the power transmission part 80 is configured as the chain 81 or the link 82, while the chain 81 or the link 82 operates according to a vertical movement of the pedal part 60, in order to minimize noise that may be generated when colliding with the curved portion of the cam body 41, a noise prevention member (not illustrated) made of cloth or rubber may be attached to the curved portion of the cam body 41.

The cam part 40 may include the cam body 41 having a hole which is inserted through the main shaft 30, and a first connection part 42 that is formed above the cam body 41 and to which one end of the chain 81 or the strap 83 is coupled by a first fixing member a. In this case, the first connection part 42 may be a first coupling position among the plurality of coupling positions described above.

At this time, the first fixing member a may be a material such as a bolt or a pin, but is not limited thereto.

At this time, the cam body 41 may have the same radius from the center of the cam part 40 to the outer circumferential surface or may not have the same radius from the center of the cam part 40 to different outer circumferential surfaces (in the case of an eccentric cam).

The other end of the chain 81 or the strap 83 may be coupled to a third connection part 63 formed on the front side of the pedal board 62 by a third fixing member c. At this time, the third fixing member c may be formed of the same material as the first fixing member a.

Accordingly, as illustrated in FIGS. 1 and 2, when the power transmission part 80 is configured as the chain 81, when the user steps on the pedal part 60 to apply a load to the pedal part 60, the chain 81 connected to the pedal board 62 may rotate the cam part 40, and the main shaft 30 is rotated according to the rotation of the cam part 40, and the hitting part 50 axially coupled to the main shaft 30 is rotated in the direction of the base drum to hit the base drum.

Alternatively, as illustrated in FIGS. 5 and 6, even when the power transmission part 80 is configured as the strap 83, the base drum may be hit in the same operation manner as when the power transmission part 80 is configured as the chain 81.

At this time, when the power transmission part 80 is configured as the chain 81 or the strap 83, in the same manner, one end of the chain 81 or the strap 83 is coupled to the first connection part 42, and the other end of the chain 81 or the strap 83 is coupled to the third connection part 63.

On the other hand, as illustrated in FIGS. 3, 4, 7 and 8, the aforementioned cam part 40 may further include a link connection guide part 43 that is insertable into the cam part 40 and movable in the front-rear direction and a guide insertion part 44 which is formed in a longitudinal direction on a first surface of the cam body 41 so that the link connection guide part 43 is inserted. In this case, the first surface of the cam body 41 may be one side of the cam body 41 illustrated in FIGS. 8A and 8B.

As illustrated in FIGS. 3 and 4, a second connection part 45 to which one end of the link 82 is coupled by a second fixing member b is formed on the front side of the link connection guide part 43, and as illustrated in FIGS. 7, 8A, and 8B, a link connection guide fixing part 46 may be formed on the rear side of the link connection guide part 43 so that the rear side of the link connection guide part 43 is fixed to the cam body 41 when the link connection guide part 43 protrudes forward. In this case, the second connection part 42 may be a second coupling position among the plurality of coupling positions described above.

At this time, the second fixing member b may be formed of the same material as the first fixing member a and the third fixing member c.

As illustrated in FIG. 8, the link connection guide part 43 may be inserted into the guide insertion part 44 from the front direction (the curved portion of the cam body 41) of the cam body 41 to the rear-side direction.

In addition, as illustrated in FIGS. 7 and 8B, a long hole 47 through which a link connection guide fixing bolt 49*a* may penetrate is formed in one side of the guide insertion part 44, and as illustrated in FIGS. 7 and 8C, a longitudinal groove 48 into which a link connection guide fixing nut 49*b* may be inserted may be formed on a second surface opposite to the first surface of the cam body 41. In this case, the second surface of the cam body 41 may be the other side of the cam body 41 illustrated in FIG. 8C.

Meanwhile, the link connection guide part 43 is inserted into the guide insertion part 44 described above to be freely movable.

At this time, before the rear side of the link connection guide part 43 is fixed to the cam body 41, the link connection guide part 43 protrudes to the outside of the cam body 41 by an arbitrary length to move the link connection guide part 43 within the guide insertion part 44. For example, as illustrated in FIG. 8B, the link connection guide part 43 may protrude to the outside of the cam body so that the link connection guide fixing part 46 is positioned about the middle of the guide insertion part 44.

When the link connection guide fixing bolt 49*a* is inserted into the link connection guide fixing part 46 while the link connection guide fixing part 46 is disposed at an arbitrary position of the guide insertion part 44, the link connection guide fixing bolt 49*a* may pass through the long hole 47 in the direction of the second surface of the cam body 41.

At this time, the above-mentioned link connection guide fixing nut 49*b* may fasten the link connection guide fixing bolt 49*a* passed in the direction of the second surface of the cam body 41 through the long hole to the cam body 41. When the link connection guide fixing bolt 49*a* is fastened to the cam body 41 as described above, the forward and backward movement of the link connection guide part 43 is restricted.

As such, the link connection guide part 43 is freely movable within the guide insertion part 44 of the cam body 41 so that the link connection guide part 43 protrudes out of the cam body 41 as much as the user wants.

At this time, a relative position of the second connection part 45 with respect to the cam body 41 may also be changed according to a protrusion length of the link connection guide part 43 from the cam body 41, and a relative position of the link 83 (one end connected to the second connection part 45) with respect to the cam body 41 may also be changed according to a change in the position of the second connection part 45. Therefore, even if the same load is applied to the pedal part 60, the rotation radius of the cam part 40 may vary, and accordingly, the strength at which the hitting part 50 hits the base drum may vary.

Accordingly, by adjusting the protrusion length of the link connection guide part 43, it is possible to simply adjust the strength of hitting the bass drum according to a user's performing preference.

In addition, as illustrated in FIGS. 3 and 4, the other end of the link 82 may be coupled to a third connection part 63 formed on the front side of the pedal board 62 by the third fixing member c like the chain 81 or the strap 83.

Meanwhile, in the drum pedal 100 according to the embodiment of the present invention, when the power transmission part 80 is configured as the chain 81 or the strap 83, as illustrated in FIGS. 1, 2, 5 and 6, the link connection guide part 43 including the second connection part 45 and the link connection guide fixing part 46 does not protrude to the outside of the cam body 41.

At this time, one end of the chain 81 or the strap 83 is coupled to the first connection part 42 through the first fixing member a, and the other end of the chain 81 or the strap 83 is connected to the third connection part 63 via the third fixing member c, thereby simplifying the connection between the cam part 40 and the pedal part 60.

In addition, when the power transmission part 80 of the drum pedal 100 is configured as the link 82, as illustrated in FIGS. 3 and 4, after the link connection guide part 43 is appropriately disposed at any position of the guide insertion parts 44, the rear side of the link connection guide part 43 is fastened to the cam body 41, one end of the link 82 is coupled to the second connection part 45 exposed to the outside of the cam body 41 via the second fixing member b, and the other end of the link 82 is coupled to the third connection part 63 via the third fixing member c to connect the cam part 40 and the pedal part 60.

Therefore, in the drum pedal 100 according to the embodiment of the present invention, a different type of power transmission part 80 may be coupled to the cam part 40 without replacing the drum pedal itself or the cam part 40 to provide the user with a feeling of stepping on various types of drum pedals conveniently without replacing the drum pedal, thereby reducing costs.

In addition, when the power transmission part 80 is configured as the chain 81, the link 82 or the strap 83, respectively, as a load is applied to the pedal part 60, the hitting strength and speed at which the hitting part 50 hits the base drum may vary, thereby providing various types of drum pedals according to the user's performing preference.

Meanwhile, as illustrated in FIGS. 1, 3 and 5, the drum pedal 100 according to the embodiment of the present invention may further include a restoration part 70.

The restoration part 70 may include a crank 71 which is fixed to the main shaft 30 and rotatably formed, and an elastic part 72 of which one end is connected to the crank 71 and the other end is connected to a tension adjustment member 73 coupled to any one of the pair of support parts 20.

The elastic part 72 is a kind of spring, and the tension of the elastic part 72 may be adjusted by adjustment (tightening and loosening) of the tension adjustment member 73 connected to the other end of the elastic part 72. At this time, since the crank 71 is axially coupled to the main shaft 30, the crank 71 may vary the feeling of stepping on the pedal part 60 by the user when a load is applied to the pedal part 60 according to the tension adjustment of the elastic part 72 through the tension adjustment member 73. In addition, when the load applied to the pedal part 60 is released, the degree to which the pedal part 60 is returned to its original position may vary.

Meanwhile, when the load is applied to the pedal part 60, the elastic part 72 may be tensioned while the crank 71 is rotated and the rotational force is transmitted to the cam part 40 by the power transmission part 80 according to the vertical rotation of the pedal part 60, and the hitting part 50 is also rotated according to the rotation of the cam part 40 to hit the base drum.

When the load applied to the pedal part 60 is released, the crank 71 may be rotated in an opposite direction to when the load is applied to the pedal part 60, and at this time, the elastic part 72 may apply the elastic force to the main shaft 30 so that the pedal part 60 and the hitting part 50 are restored to their original positions while being compressed in an original state.

In addition, as illustrated in FIGS. 1, 3 and 5, the drum pedal 100 according to the embodiment of the present invention may further include a cramping part 90.

As illustrated in FIG. 3, the clamping part 90 may include a clamp 91 for fixing the base part 10 to a hoop (not illustrated) of the base drum, a lever 93 for supporting the lower side of the clamp 91, and a clamp fastening screw 92 coupled to one side of the lever 93.

The clamp 91 illustrated in FIG. 3 is fixed to the hoop of the base drum so that the base part 10 is stably fixed without moving.

When the clamp 91 is fixed to the hoop of the base drum, the lever 93 is positioned to support the lower side of the clamp 91 and the lever 93 is lifted by tightening the clamp fastening screw 92 coupled to one side of the lever 93 so that the front side of the cramp 91 is lowered, thereby preventing the cramp 91 from being separated from the hoop of the base drum.

When the clamp 91 is separated from the hoop of the base drum, if the clamp fastening screw 92 is loosened, the lever 93 is lowered and the front side of the clamp 91 rises, and accordingly, the clamp 91 may be separated from the hoop of the base drum.

In addition, for the convenience of the user, the clamp fastening screw 92 may be positioned on the front side of the base part 10, and although not illustrated, a clamp height adjustment member (not illustrated) is formed in the approximate center of the clamp 91 to adjust the height of the clamp 91 according to a hoop thickness of the base drum.

FIGS. 9 and 10 are diagrams illustrating the pedal part in detail according to an embodiment of the present invention.

Here, FIG. 9 is a perspective view of the drum pedal 100 according to an embodiment of the present invention when viewed from the side, and FIG. 10A is a view of a partial configuration of the pedal part 60 when viewed from the lower side, and FIG. 10B is a view illustrating a coupling of the base part 10 and the rail 65.

Referring to FIG. 9, the pedal part 60 may include a heel part 61 coupled to the rear side of the base part 10 and adjustable in a front-rear direction, and a pedal board 62 rotatably provided with respect to the heel part 61.

As illustrated in FIGS. 10A and 10C, the hinge part 66 may include a hinge shaft 661 supported by a hinge bearing 662 and formed rotatably, a board coupling part 663 formed on one side of the hinge shaft 661 and coupled to the pedal board 62, and a heel coupling part 664 formed on the other side of the hinge shaft 661 and coupled to the heel part 61.

Accordingly, the pedal board 62 may be hinged to the heel part 61 by the hinge part 66, and may be rotatable vertically around the hinge part 66.

In addition, as illustrated in FIG. 10B, a rail 65 may be provided on the rear side of the base part 10, and as illustrated in FIG. 10A, the pedal part 60 may further include a rail guide 64 formed on the lower side of the heel part 61 and inserted with the rail 65.

The rail 65 is provided to be fixed to the base part 10, and in one embodiment, the rail 65 described above may be fixed to the base part 10 by the rail fixing part 651 as illustrated in FIG. 10B, and a vertical cross-sectional shape of the rail guide 64 may be formed in a substantially circular shape to correspond to the cylindrical rail 65. However, in the embodiment of the present invention, the rail 65 may be fixed to the base part 10 in the same manner as welding, and if the shape is not only a cylindrical shape, but also may be other shapes so long as a shape may be inserted by the rail guide 64.

At this time, since the rail 65 is inserted into the heel part 61 in the longitudinal direction from the rear side of the rail 65 by the rail guide 64, the heel part 61 may move along the rail 65 in the front-rear direction of the base part 10.

Meanwhile, on the front side of the heel part 61, as illustrated in FIG. 10C, a first stopper 67 penetrating from the upper portion of the heel part 61 downwardly may be formed, and the first stopper 67 comes into contact with the lower end of the heel part 61 when the heel part 61 moves in the front direction of the base part 10, thereby limiting the movement of the heel part 61 in the front direction by a predetermined distance or more. Accordingly, when the heel part 61 moves in the front direction of the base part 10, it is possible to prevent the heel part 61 from being separated from the front side of the rail 65 by the configuration of the first stopper 67.

In addition, as illustrated in FIGS. 10C to 10E, when the heel part 61 moves in the rearward direction of the base part 10, a second stopper 68 for preventing the separation of the heel part 61 may be coupled to the rear side of the rail 65. The second stopper 68 may be a type of washer, but is not limited thereto.

In addition, as illustrated in FIGS. 10C to 10E, the heel part 61 may be formed with a plurality of heel part fixing members 611 for fixing the position of the heel part 61 when the heel part 61 moves in the front-rear direction of the base part 10 along the rail 65.

Although not illustrated in the drawing, a plurality of fixing grooves into which the heel part fixing members 611 may be inserted may be formed on the rail 65, and the heel part fixing member 611 may be a screw, and the heel part fixing member 611 may be inserted into the heel part 61 to fix the heel part 61 to the rail 65 after the user moves the heel part 61 to a desired position. Accordingly, the user may perform stable performance after moving the heel part 61 to a desired position and then fixing the position of the heel part 61 through the heel part fixing member 611.

Therefore, in the drum pedal 100 according to the embodiment of the present invention, the position of the heel part 61 may be freely adjusted within a predetermined distance range.

In addition, since the pedal board 62 connected to the heel part 61 can also move in the front-rear direction as the heel part 61 moves in the front-rear direction, the rotation radius of the power transmission part 80 coupled to the front side of the pedal board 62 increases when the heel part 61 moves to the front side of the base part 10, thereby providing the feeling of operating different drum pedals 100 to the user as compared with a state where the heel part 61 is positioned in an original position. Accordingly, by adjusting the position of the heel part 61 according to the user's preference, it is possible to provide the user with a feeling of stepping on various types of drum pedals 100.

Meanwhile, as illustrated in FIG. 9, at least one weight adjustment member seating groove 621 into which a weight adjustment member (not illustrated) can be inserted may be formed in the pedal board 62. The weight adjustment member may be initially mounted on the pedal board 62.

In the pedal board 62 of the present invention, it is possible to reduce the weight of the pedal board 62 by removing the weight adjustment member positioned in the weight adjustment member seating groove 621 described above, thereby hitting the base drum more quickly The above description just illustrates the technical spirit of the present invention and various changes, modifications, and substitutions can be made by those skilled in the art to which the present invention pertains without departing from an essential characteristic of the present invention. Therefore, the exemplary embodiments and the accompanying drawings disclosed in the present invention are used to not limit but describe the technical spirit of the present invention and the scope of the technical spirit of the present invention is not limited by the exemplary embodiments and the accompanying drawings. The protective scope of the present invention should be construed based on the appended claims, and all the technical spirits in the equivalent scope thereof should be construed as falling within the scope of the present invention.

The invention claimed is:

1. A drum pedal comprising:

a base part;

a pair of support parts provided at the front side of the base part;

a cam part that is axially coupled to the pair of support parts via a main shaft;

a hitting part that is axially coupled to the pair of support parts via the main shaft and disposed to be adjacent to the cam part;

a pedal part of which one end is coupled to the rear side of the base part and which is formed to extend in the direction of the front side of the base part; and a power transmission part that connects the cam part and the pedal part and rotates the main shaft and the cam part according to a load applied to the pedal part, wherein at least two different power transmission parts are able to be selectively coupled to the cam part, wherein the cam part comprises a cam body having a hole which is inserted through the main shaft, a link connection guide part that is insertable into the cam part and movable in the front-rear direction, a guide insertion part which is formed in a longitudinal direction on a first surface of the cam body so that the link connection guide part is inserted, and a first connection part that is formed above the cam body and to which one end of the chain or the strap is coupled by a first fixing member, wherein a rotation radius of the cam part varies depending on a position of an action point at which at least two different power transmission parts are coupled to the cam part, the power transmission part is any one of a chain, a link, and a strap, and a second connection part to which one end of the link is coupled by a second fixing member is formed on the front side of the link connection guide part, and a link connection guide fixing part is formed on the rear side of the link connection guide part so that the rear side of the link connection guide part is fixed to the cam body when the link connection guide part protrudes forward.

2. The drum pedal of claim 1, wherein the link connection guide part is inserted into the guide insertion part, a long hole through which a link connection guide fixing bolt penetrates is formed in one side of the guide insertion part, and a longitudinal groove into which a link connection guide fixing nut is insertable is formed in a second surface opposite to the first surface of the cam body.

3. The drum pedal of claim 2, wherein the link connection guide fixing bolt is inserted into the link connection guide fixing part, and the link connection guide fixing nut fastens the link connection guide fixing bolt passing through the long hole in the direction of the second surface with the cam body.

4. The drum pedal of claim 1, wherein the pedal part comprises a heel part coupled to the rear side of the base part and movable in a front-rear direction, a pedal board rotatably provided with respect to the heel part, and a third connection part formed on the front side of the pedal board and coupled with the other end of the power transmission part by a third fixing member.

5. The drum pedal of claim 1, further comprising:

a restoration part which includes a crank which is fixed to the main shaft, and an elastic part of which one end is connected to the crank and the other end is connected to a tension adjustment member coupled to any one of the pair of support parts, wherein when a load applied to the pedal part is released, the restoration part applies an elastic force to the main shaft so that the pedal part and the hitting part are restored to original positions.

6. The drum pedal of claim 1, further comprising:

a clamping part which is formed at the front side of the base part to support the base drum.

* * * * *